US011965414B2

(12) United States Patent
Nafa et al.

(10) Patent No.: US 11,965,414 B2
(45) Date of Patent: Apr. 23, 2024

(54) INTERCHANGEABLE LEAD IMPRESSION BLOCK

(71) Applicant: Saudi Arabian Oil Company, Dhahran (SA)

(72) Inventors: Hamed Nafa, Juaymah (SA); Majid Al-Hajjaji, Juaymah (SA); Adel Khalil Al-Ahmadi, Juaymah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/477,254

(22) Filed: Sep. 16, 2021

(65) Prior Publication Data

US 2023/0082225 A1 Mar. 16, 2023

(51) Int. Cl.
*E21B 17/042* (2006.01)
*E21B 47/01* (2012.01)
*E21B 47/098* (2012.01)

(52) U.S. Cl.
CPC ..... *E21B 47/01* (2013.01); *E21B 17/042* (2013.01); *E21B 47/098* (2020.05)

(58) Field of Classification Search
CPC ..... E21B 47/098; E21B 31/00; E21B 47/01; E21B 17/042
See application file for complete search history.

(56) References Cited

U.S. PATENT DOCUMENTS 4,616,987 A 10/1986 Boyers et al.
8,403,056 B2 3/2013 Gette et al.
8,727,755 B2 5/2014 Guidry et al.
10,954,752 B2 3/2021 Manson et al.
2012/0261132 A1* 10/2012 Wilson ..... E21B 47/098 166/241.1
2014/0217639 A1* 8/2014 Guidry ..... E21B 47/098 264/220

(Continued)

FOREIGN PATENT DOCUMENTS

CN 202882854 U 4/2013
CN 103161441 A 6/2013
GB 2549282 A * 10/2017 ..... E21B 47/09

(Continued)

OTHER PUBLICATIONS

Peak Well Systems (Peak); Peak Impression Block (PIB) retrieved from https://www.peakwellsystems.com/products/well-intervention/fishing-systems/peak-impression-block-(pib).aspx.

*Primary Examiner* — Caroline N Butcher
(74) *Attorney, Agent, or Firm* — Bracewell LLP; Constance G. Rhebergen; Keith R. Derrington

(57) ABSTRACT

Systems and methods for obtaining a shape of a component within a subterranean well with an impression tool includes the impression tool having a top sub. The top sub is an elongated member having a central axis and a downhole facing surface. A threaded recess of the top sub extends axially from the downhole facing surface. A bottom body section has a block body, a lead impression block positioned at a downhole side of the block body, and a threaded member located at an uphole side of the block body. The threaded member of the bottom body section threadingly engages the threaded recess of the top sub. The bottom body section is operable to be selectively threaded to, and unthreaded from, the top sub.

19 Claims, 3 Drawing Sheets

(56) References Cited

U.S. PATENT DOCUMENTS

| | | | | |
|---|---|---|---|---|
| 2016/0102527 | A1* | 4/2016 | Manson | E21B 31/00<br>166/243 |
| 2017/0314344 | A1* | 11/2017 | Tavakoli | E21B 19/06 |

FOREIGN PATENT DOCUMENTS

| | | | |
|---|---|---|---|
| GB | 2549282 | A | 10/2017 |
| WO | 2017158573 | | 9/2017 |

* cited by examiner

INTERCHANGEABLE LEAD IMPRESSION BLOCK

BACKGROUND OF THE DISCLOSURE

1. Field of the Disclosure

The disclosure relates generally to intervention operations within a subterranean well, and more particularly to identifying obstructions and damage within the subterranean well.

2. Description of the Related Art

During well intervention operations, a lead impression block can be used for obtaining an impression of items within a wellbore. Based on information obtained from the impression, next steps for handling of the item can be determined. For example, if equipment or tools are lost down hole, the impression can be used for determining the correct fishing tool for removing the lost equipment or tools. Alternately, the impression can provide size and shape information relating to other blockages, obstructions, or damage so that an appropriate intervention strategy for dealing with such blockages, obstructions, or damages can be developed.

SUMMARY OF THE DISCLOSURE

For some currently available lead impression block tools, after an impression has been made, the tool cannot be reused until the tool is returned to a shop to redress the lead impression block. If the impression does not provide sufficient information for performing the intervention operation, the tool cannot be reused to take a subsequent impression until the redressing has been completed. The redressing operation generally requires the use of molten lead to arrive at a lead impression block that is ready for use for obtaining a subsequent impression. Therefore the procedure for performing multiple runs with the lead impression tool is inefficient and time consuming.

In addition, currently available lead impression tools have a lead impression block with a fixed outer diameter size so that the tool is only capable of taking impressions with a single size of lead impression block. In order to accommodate the possibility of the need for lead impression blocks of different sizes, storage for entire separate lead impression tools, each of a different size, would be required. And with a single lead impression block being used for each tool, if the lead element is damaged during transportation the damaged lead impression tool would have limited usefulness.

Embodiments of this disclosure provide embodiments of an impression tool that has a top sub that is separable from an interchangeable bottom body section. The bottom body section can be threaded into the top sub of the tool by hand on site. The bottom body section can include a lead impression block of a variety of outer diameter sizes, any of which can be used with the same top sub. A number of bottom body sections of the impression tool can be maintained on site in a variety of sizes. Use of the impression tool of embodiments of this disclosure will allow for efficiently obtaining multiple impressions with a single top sub.

In an embodiment of this disclosure, an impression tool for obtaining a shape of a component within a subterranean well has a top sub. The top sub is an elongated member having a central axis and a downhole facing surface. A threaded recess of the top sub extends axially from the downhole facing surface. A bottom body section has a block body, a lead impression block positioned at a downhole side of the block body, and a threaded member located at an uphole side of the block body. The threaded member of the bottom body section threadingly engages the threaded recess of the top sub. The bottom body section is operable to be selectively threaded to, and unthreaded from, the top sub.

In alternate embodiments, the bottom body section can be operable to be selectively secured to, and removed from, the top sub by hand. The threaded recess and the threaded member can be centered along the central axis of the top sub. The top sub can further include a fish neck. The fish neck can have a reduced neck portion and an enlarged neck portion, an outer diameter of the reduced neck portion being smaller than an outer diameter of the enlarged neck portion.

In other alternate embodiments, the top sub can have a cylindrical shape with a top sub maximum outer diameter, and the bottom body section can have a cylindrical shape with a bottom body section maximum outer diameter. The top sub maximum outer diameter can be smaller than the bottom body section maximum outer diameter. The top sub maximum outer diameter can be fixed and the bottom body section maximum outer diameter can be selectable.

In an alternate embodiment of this disclosure, a system for obtaining a shape of a component within a subterranean well has an impression tool secured to a delivery string. The impression tool has a top sub. The top sub is an elongated member having a central axis, a connector member located at a terminal uphole end of the top sub, and a threaded recess located at a terminal downhole end of the top sub. A bottom body section has a block body, a lead impression block positioned at a downhole side of the block body, and a threaded member located at an uphole side of the block body. The threaded member of the bottom body section threadingly engages the threaded recess of the top sub. The bottom body section is operable to be selectively threaded to, and unthreaded from, the top sub by hand. The connector member secures the impression tool to the delivery string. The delivery string extends from an earth's surface into a wellbore of the subterranean well a sufficient distance for the impression tool to engage the component within the wellbore.

In alternate embodiments, the threaded recess and the threaded member can be centered along the central axis of the top sub. The bottom body section can have a bottom body section maximum outer diameter, and the bottom body section maximum outer diameter can be selectable. The bottom body section can be operable to be changed by hand. The lead impression block can be retained with the block body when the bottom body section is changed. The bottom body section can be operable to be changed by hand solely by relative rotation between the top sub and the bottom body section; where the relative rotation can be about the central axis of the top sub.

In yet another alternate embodiment of this disclosure, a method for obtaining a shape of a component within a subterranean well with an impression tool includes providing the impression tool. The impression tool has a top sub. The top sub is an elongated member having a central axis, a connector member located at a terminal uphole end of the top sub, and a threaded recess located at a terminal downhole end of the top sub. A bottom body section has a block body, a lead impression block positioned at a downhole side of the block body, and a threaded member located at an uphole side of the block body. The threaded member of the bottom body section threadingly engages the threaded recess of the top sub. The impression tool is secured to a delivery string. The delivery string is extended from an earth's surface into a wellbore of the subterranean well a sufficient distance for the impression tool to engage the component within the wellbore. The connector member secures the impression tool to the delivery string. The bottom body section is selectively threaded to, and unthreaded from, the top sub by hand.

In alternate embodiments, the method can further include retrieving the impression tool from the subterranean well with the delivery string. The top sub can have a cylindrical shape with a top sub maximum outer diameter. The bottom body section can have a cylindrical shape with a bottom body section maximum outer diameter. The top sub maximum outer diameter can be fixed and the bottom body section maximum outer diameter can be selectable.

In other alternate embodiments, the bottom body section can have a bottom body section maximum outer diameter, and the bottom body section can be an initial bottom with an initial bottom maximum outer diameter. The method can further include selecting a replacement bottom, the replacement bottom being a bottom body section selected from a collection of bottom body sections having a variety of bottom body section maximum outer diameters. The initial bottom can be removed solely by relative rotation between the top sub and the initial bottom, where the relative rotation can be about the central axis of the top sub. The replacement bottom can be installed solely by relative rotation between the top sub and the replacement bottom, where the relative rotation can be about the central axis of the top sub. The lead impression block of the initial bottom can be retained with the block body of the initial bottom. The lead impression block of the replacement bottom can be retained with the block body of the replacement bottom.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
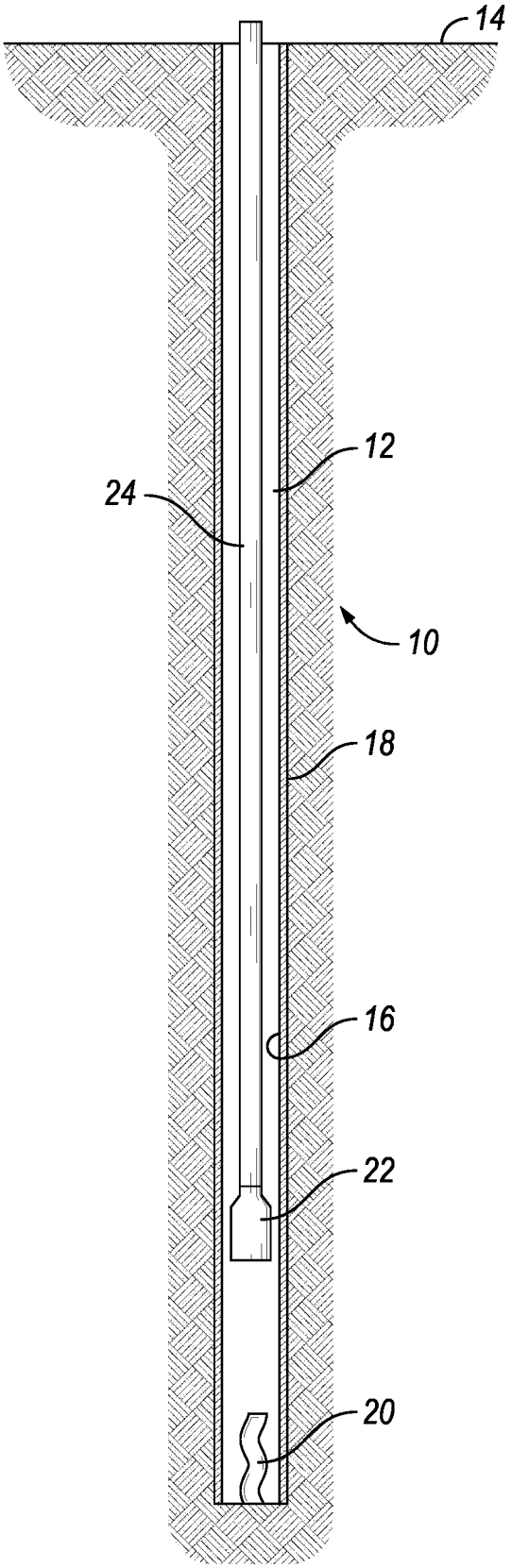
FIG. 1 is a schematic sectional representation of a subterranean well having an interchangeable lead impression block, in accordance with an embodiment of this disclosure.

Referring to FIG. 1, subterranean well 10 can have wellbore 12 that extends from an earth's surface 14. Subterranean well 10 can be an offshore well or a land based well and can be a well associated with hydrocarbon development operations, such as, for example, a hydrocarbon production well, an injection well, or a water well. Wellbore 12 can be drilled from surface 14 and into and through various subterranean formations.

Casing 16 can line an inner diameter surface of wellbore 12. Casing 16 can be formed of a series of tubular pipe joints that are secured end to end. Casing 16 can be a tubular member that has a bore. In alternate embodiments, wellbore 12 can have an unlined or open hole that is free of casing over at least a portion of a length of wellbore 12.

There may be times during the development or operation of subterranean well 10 that items are lost within wellbore 12. Such items are commonly called fish or junk. The items can be, for example, junk metal, tools, parts or pieces of drill pipe or drill collars, drilling components, or other components used within the subterranean well 10. The item that is accidentally dropped or left within wellbore 12 can fall to the bottom of wellbore 12.

There may alternately be times during the development or operation of subterranean well 10 that there are blockages or obstructions within wellbore 12, or damage to tubular members or equipment within wellbore 12.

Impression tool 22 can be used to identify the shape, size, and location of items that are lost within wellbore 12, to identify the size, shape and location of blockages or obstructions within wellbore 12, or to identify the size and shape of damage to tubular members or equipment within wellbore 12. Looking at FIG. 1, component 20 is shown generically as an item that has been lost within wellbore 12, as an item that is blocking or obstructing wellbore 12, or as a damaged feature of wellbore 12.

Impression tool 22 can be lowered into wellbore 12 on delivery string 24. Delivery string 24 can be, for example, a wireline, slick line, e-line, or other cable. In alternate embodiments, delivery string 24 can be a tubular member. Impression tool 22 can be lowered from earth's surface 14 into wellbore 12. Delivery string 24 extends from earth's surface 14 into subterranean well 10 a sufficient distance for impression tool 22 to engage component 20 within the wellbore 12.

Figure 2:
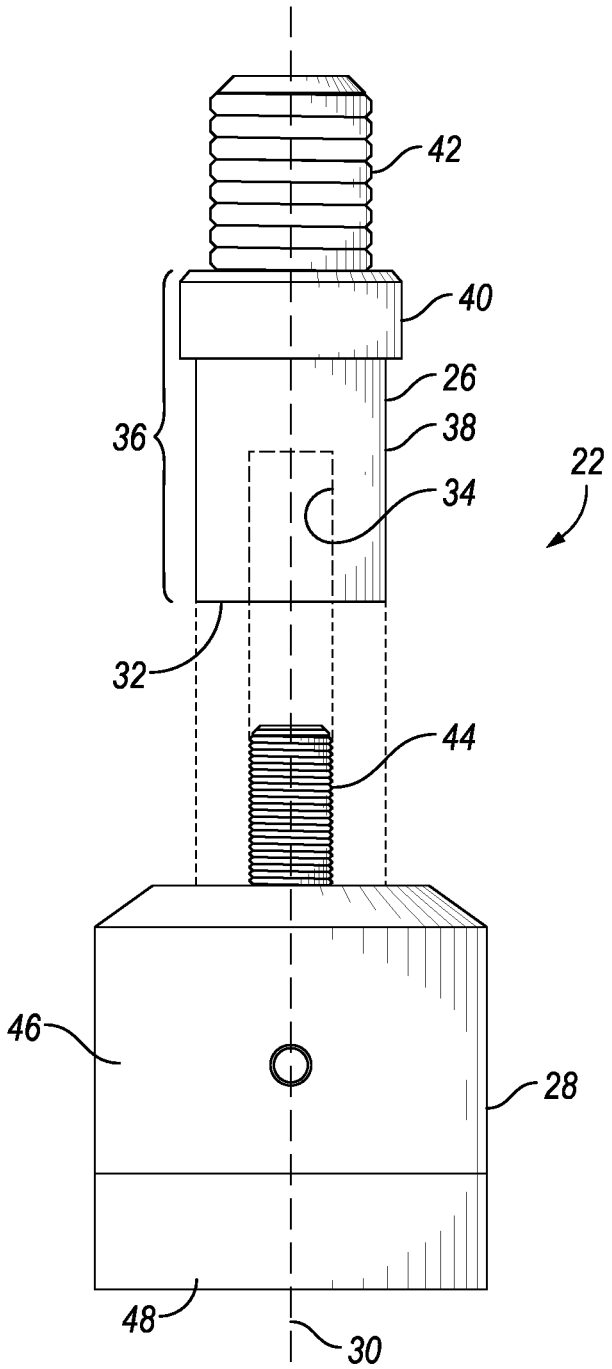
FIG. 2 is an exploded perspective view of an interchangeable lead impression block, in accordance with an embodiment of this disclosure.

Looking at FIGS. 2, impression tool 22 includes top sub 26 and bottom body section 28. Top sub 26 is an elongated member having central axis 30. Top sub 26 can be generally symmetrical about central axis 30.

Top sub 26 has downward facing surface 32. Downward facing surface 32 can be a level surface at the terminal downhole end of top sub 26. Threaded recess 34 can have an open end at downward facing surface 32. Threaded recess 34 can extend axially in an uphole direction from downward facing surface 32. Threaded recess 34 can be centered along central axis 30.

Top sub 26 further includes fish neck 36. Fish neck 36 extends along central axis 30. Fish neck 36 has reduced neck portion 38 and an enlarged neck portion 40. An outer diameter of reduced neck portion 38 is smaller than an outer diameter of enlarged neck portion 40. Fish neck 36 provides a profile that can be grasped by a fishing tool. As an example, if impression tool 22 is released from delivery string 24 within subterranean well 10, a fishing tool can be deployed to grasp impression tool 22 and retrieve impression tool 22 from wellbore 12 of subterranean well 10.

Top sub 26 also includes connector member 42. Connector member 42 is at a terminal uphole end of top sub 26. Connector member 42 can be used to secure impression tool 22 to delivery string 24. In the example embodiments shown, connector member 42 is a threaded male connector. In such an embodiment, connector member 42 would be secured to a threaded female connector of delivery string 24. In alternate embodiments, connector member 42 can be another type of connection means for securing impression tool 22 to delivery string 24.

Bottom body section 28 includes threaded member 44, block body 46, and lead impression block 48. Threaded member 44 is located at an uphole side of block body 46 and lead impression block 48 is located at a downhole side of block body 46.

Threaded member 44 is at the terminal uphole end of bottom body section 28. Threaded member 44 is centered along central axis 30. Threaded member 44 is sized and positioned to engage threaded recess 34. Threaded member 44 and threaded recess 34 allow for bottom section 28 to be selectively threaded to, and unthreaded from, top sub 26.

Threaded member 44 of bottom body section 28 threadingly engages threaded recess 34 of top sub 26 in a manner that allows for bottom body section 28 to be selectively threaded to, and unthreaded from, top sub 26 by hand. That is, an operator can use a simple mechanical tool such as a wrench, to remove bottom body section 28 from top sub 26. Bottom body section 28 can be removed from top sub 26 on site by an operator solely by relative rotation between top sub 26 and bottom body section 28. The relative rotation between top sub 26 and bottom body section 28 for the removal of bottom body section 28 from top sub 26 is about the central axis 30.

Figure 5:
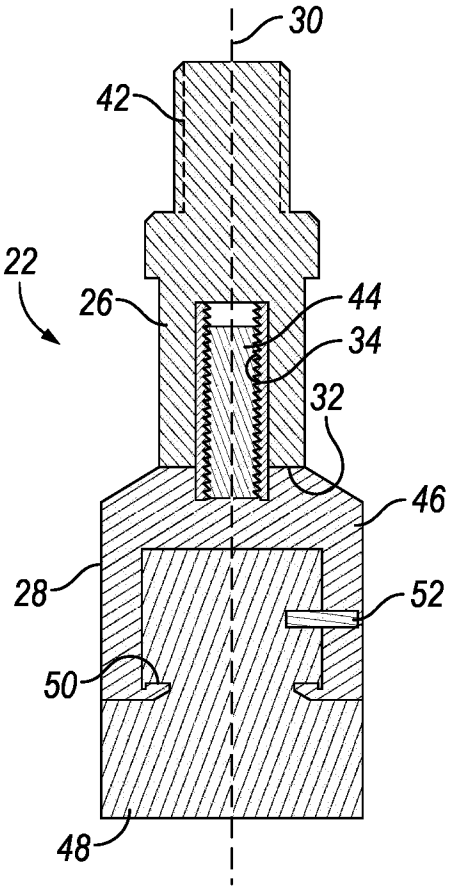
FIG. 5 is an elevational partial section view of an interchangeable lead impression block, in accordance with an embodiment of this disclosure, shown with a lead impression block of an example third size.
Figure 4:
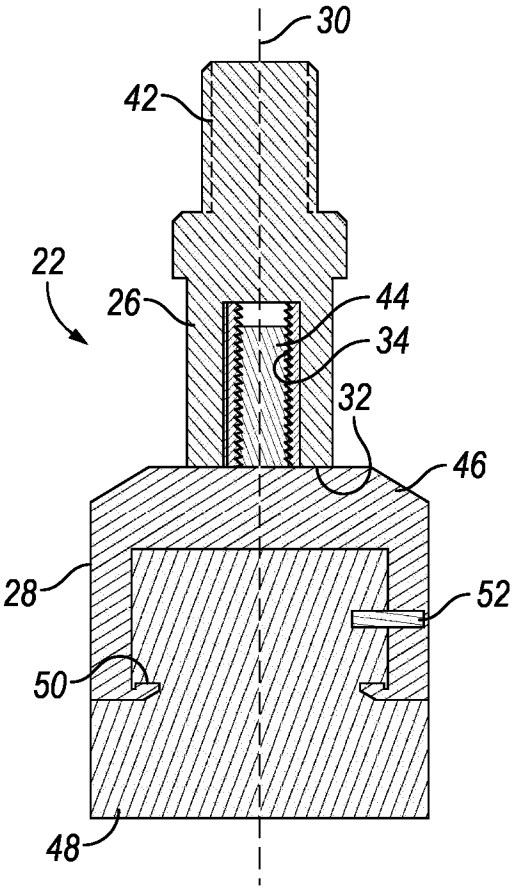
FIG. 4 is an elevational partial section view of an interchangeable lead impression block, in accordance with an embodiment of this disclosure, shown with a lead impression block of an example second size.
Figure 3:
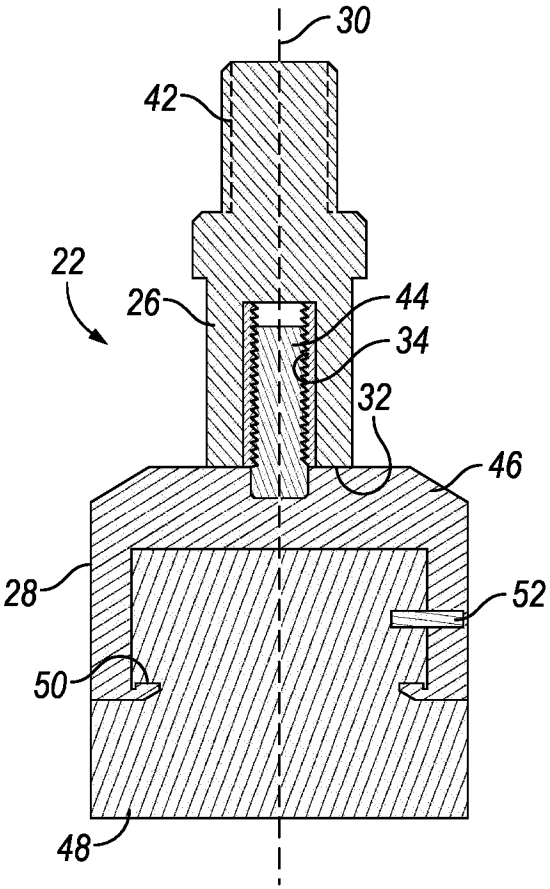
FIG. 3 is an elevational partial section view of an interchangeable lead impression block, in accordance with an embodiment of this disclosure, shown with a lead impression block of an example first size.

Looking at FIGS. 3-5, threaded member 44 can be secured to an uphole side of block body 46, for example, by welding threaded member 44 within a recess of block body 46 (FIG. 3), by welding threaded member 44 to an uphole facing surface of block body 46 (FIG. 4), by threading threaded member 44 within a recess of block body 46 (FIG. 5), or by other suitable means.

Lead impression block 48 can be secured to a downhole side of block body 46. Looking at FIGS. 3-5, a portion of lead impression block 48 can be housed within an inner cavity of block body 46. The inner cavity of block body 46 can be shaped to retain the portion of lead impression block within the inner cavity. In the example embodiments of FIGS. 3-5, the inner cavity of block body 46 has uphole facing shoulder 50. Uphole facing shoulder 50 limits relative axial movement between block body 46 and lead impression block 48. One or more pins 52 can extend radially between block body 46 and lead impression block 48. Pin 52 can limit relative rotational movement between block body 46 and lead impression block 48.

In embodiments of this disclosure, bottom body section 28 can be changed by hand solely by relative rotation between top sub 26 and bottom body section 28. Because lead impression block 48 is secured within an inner cavity of block body 46, when bottom body section 28 is removed from top sub 26, lead impression block 48 is retained with block body 46. Because top sub 26 does not need to be removed from delivery string 24, when replacing bottom body section 28, the maximum outer diameter of top sub 26 will remain fixed, while the maximum outer diameter of bottom body section is selectable.

In the example embodiments of FIGS. 3-5, top sub 26 has a cylindrical shape with a top sub maximum outer diameter, and bottom body section 28 has a cylindrical shape with a bottom body section maximum outer diameter. However, as can be seen by comparing FIGS. 3-5, the maximum outer diameter of bottom body section 28 can be selected. In each of the example embodiments of FIGS. 3-5, the top sub maximum outer diameter is smaller than the bottom body section maximum outer diameter. Also in each of the embodiments of FIGS. 3-5, the maximum outer diameter of bottom body section 28 is substantially equal to the maximum outer diameter of lead impression block 48.

As can be seen in the example embodiments of FIGS. 3-5, while top sub 26 has a fixed top sub maximum outer diameter, an operator can secure a bottom body section 28 that has a bottom body section maximum outer diameter selected from a range of sizes, for securing to top sub 26.

In an example of operation, when measurement of the shape of component 20 within subterranean well 10 is desired, an operator can secure impression tool 22 to delivery string 24. Delivery string 24 can extend from earth's surface 14 into wellbore 12 of subterranean well 10 a sufficient distance for impression tool 22 to engage component 20 within wellbore 12. Lead impression block 48 is sufficiently malleable to be imprinted with the shape of component 20. The orientation and location of component 20 can also be generally determined by impression tool 22.

Delivery string 24 can retrieve impression tool 22 from subterranean well 10 so that the impression obtained by lead impression block 48 can be interpreted. In order to remove bottom body section 28 from top sub 26, an operator can unthread bottom body section 28 from top sub 26 by relative rotation between bottom body section 28 from top sub 26 about central axis 30. The removal of bottom body section 28 from top sub 26 can be by hand.

If a next impression of the same component 20 or a different component is desired, a replacement bottom can be selected. The replacement bottom is a bottom body section 28 that is selected from a collection of bottom body sections having a variety of bottom body section maximum outer diameters. The maximum outer diameter of the replacement bottom can be the same or can be different that the maximum outer diameter of the initial bottom. The replacement bottom can be secured top sub 26 solely by relative rotation between top sub 26 and the replacement bottom. Such relative rotation is about central axis 30.

During removal of the initial bottom from top sub 26, the lead impression block of the initial bottom is retained with the block body of the initial bottom. In addition, lead impression block of the replacement bottom is retained with the block body of the replacement bottom when replacement bottom is secured to, and removed from top sub 26.

Embodiments of this disclosure therefore provide systems and method for efficiently obtaining multiple impressions of one or more components downhole with either a similarly sized lead impression block, or different sizes of impression blocks. During such operations, the top sub can remain secured to the delivery string, while the initial bottom body section can be unthreaded from the top sub by hand and be replaced with a replacement and any subsequent bottom body sections directly on site.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. An impression tool for obtaining a shape of a component within a subterranean well, the impression tool having:
- a top sub, the top sub being an elongated member having a central axis and a downhole facing surface;
- a threaded recess of the top sub extending axially from the downhole facing surface; and
- a bottom body section comprising,
  - a block body,
  - a lead impression block, and
  - a threaded member having an outer surface, an uphole end, a downhole end, and threads extending between the uphole end and downhole end, the downhole end threadingly attached to an uphole side of the block body and the uphole end threadingly engaged with the threaded recess.

2. The impression tool of claim 1, where the bottom body section is operable to be selectively secured to, and removed from, the top sub by hand.

3. The impression tool of claim 1, where the threaded recess and the threaded member are centered along the central axis of the top sub.

4. The impression tool of claim 1, where the top sub further includes a fish neck, the fish neck having a reduced neck portion and an enlarged neck portion, an outer diameter of the reduced neck portion being smaller than an outer diameter of the enlarged neck portion.

5. The impression tool of claim 1, where the top sub has a cylindrical shape and the bottom body section has a cylindrical shape.

6. The impression tool of claim 5, where the top sub has a maximum outer diameter that is fixed, and the bottom body section has a maximum outer diameter that is selectable.

7. A system for obtaining a shape of a component within a subterranean well, the system having:
- an impression tool secured to a delivery string, the impression tool having:
- a top sub, the top sub being an elongated member having a central axis, a connector member located at a terminal uphole end of the top sub, and a threaded recess located at a terminal downhole end of the top sub;
- a bottom body section, the bottom body section having a block body, a lead impression block positioned at a downhole side of the block body, and a threaded member having a downhole end threaded to an uphole side of the block body and an uphole end selectively threaded into the threaded recess, so that
- the bottom body section is operable to be selectively threaded to, and unthreaded from, the top sub;
- the connector member secures the impression tool to the delivery string; and
- the delivery string extends from an earth's surface into a wellbore of the subterranean well a sufficient distance for the impression tool to engage the component within the wellbore.

8. The system of claim 7, where the threaded recess and the threaded member are centered along the central axis of the top sub.

9. The system of claim 7, where the bottom body section has a bottom body section maximum outer diameter, and where the bottom body section maximum outer diameter is selectable.

10. The system of claim 7, where the bottom body section is operable to be changed by hand, and where the lead impression block is retained with the block body when the bottom body section is changed.

11. The system of claim 7, where the bottom body section is operable to be changed by hand solely by relative rotation between the top sub and the bottom body section; where the relative rotation is about the central axis of the top sub.

12. A method for obtaining a shape of a component within a subterranean well with an impression tool, the method including:
- providing the impression tool having:
  - a top sub, the top sub being an elongated member having a central axis, a connector member located at a terminal uphole end of the top sub, and a threaded recess located at a terminal downhole end of the top sub; and
  - a bottom body section, the bottom body section having a block body, a lead impression block positioned at a downhole side of the block body, and a threaded member having a downhole end threadingly attached to an uphole side of the block body;
- threadingly engaging an uphole end of the threaded member of the bottom body section with the threaded recess of the top sub;
- limiting axial and radial movement between the lead impression block and block body with a shoulder in the block body and pin that extends radially between the lead impression block and block body;
- securing the impression tool to a delivery string;

extending the delivery string from an earth's surface into a wellbore of the subterranean well a sufficient distance for the impression tool to engage the component within the wellbore; where the connector member secures the impression tool to the delivery string; and the bottom body section is selectively threaded to, and unthreaded from, the top sub; and replacing the bottom body section with a replacement bottom body section selected from a collection of replacement bottom body sections having variable maximum outer diameters.

13. The method of claim 12, further including retrieving the impression tool from the subterranean well with the delivery string.

14. The method of claim 12, where the top sub has a cylindrical shape with a top sub maximum outer diameter, and the bottom body section has a cylindrical shape with a bottom body section maximum outer diameter, where the top sub maximum outer diameter is fixed and the bottom body section maximum outer diameter is selectable.

15. The method of claim 12, where the bottom body section has a bottom body section maximum outer diameter and where the bottom body section is an initial bottom with an initial bottom maximum outer diameter, and where an upper surface of the replacement bottom body section has a maximum outer diameter greater than a maximum outer diameter than the bottom body section.

16. The method of claim 15, further including removing the initial bottom solely by relative rotation between the top sub and the initial bottom, where the relative rotation is about the central axis of the top sub.

17. The method of claim 15, further including installing the replacement bottom solely by relative rotation between the top sub and the replacement bottom, where the relative rotation is about the central axis of the top sub.

18. The method of claim 15, where the lead impression block of the initial bottom is retained with the block body of the initial bottom, and the lead impression block of the replacement bottom is retained with the block body of the replacement bottom.

19. The method of claim 12, where threads are formed on an outer surface of the threaded member that extend between the uphole and downhole ends of the threaded member.

* * * * *